US008376467B2

(12) United States Patent
Junker et al.

(10) Patent No.: US 8,376,467 B2
(45) Date of Patent: Feb. 19, 2013

(54) METHOD FOR AUTOMATICALLY PRODUCING A DEFINED FACE OPENING IN PLOW OPERATIONS IN COAL MINING

(75) Inventors: Martin Junker, Rheinberg (DE); Armin Mozar, Hamm (DE)

(73) Assignee: RAG Aktiengesellschaft (DE)

( * ) Notice: Subject to any disclaimer, the term of this patent is extended or adjusted under 35 U.S.C. 154(b) by 363 days.

(21) Appl. No.: 12/918,481

(22) PCT Filed: Feb. 19, 2008

(86) PCT No.: PCT/EP2008/001268

§ 371 (c)(1), (2), (4) Date: Aug. 19, 2010

(87) PCT Pub. No.: WO2009/103309

PCT Pub. Date: Aug. 27, 2009

(65) Prior Publication Data

US 2011/0006584 A1 Jan. 13, 2011

(51) Int. Cl.
*E21C 35/14* (2006.01)

(52) U.S. Cl. ..... 299/1.6

(58) Field of Classification Search ..... 299/1.6, 299/1.5, 1.05

See application file for complete search history.

(56) References Cited

U.S. PATENT DOCUMENTS

| | | | | |
|---|---|---|---|---|
| 4,228,508 | A | 10/1980 | Benthaus | |
| 4,427,321 | A | 1/1984 | Weirich et al. | |
| 4,755,084 | A | 7/1988 | Peters et al. | |
| 4,887,935 | A * | 12/1989 | Koppers et al. | 405/302 |
| 4,964,675 | A | 10/1990 | Welzel | |
| 5,137,336 | A * | 8/1992 | Merten | 299/1.7 |
| 5,553,925 | A | 9/1996 | Merten et al. | |
| 5,743,679 | A | 4/1998 | Gottschlich | |
| 6,056,481 | A | 5/2000 | Watermann et al. | |

(Continued)

FOREIGN PATENT DOCUMENTS

| | | |
|---|---|---|
| DE | 1758270 | 1/1971 |
| DE | 3620880 | 6/1987 |
| DE | 3813195 A1 * | 11/1989 |
| DE | 19907344 | 8/2000 |
| GB | 2090896 | 7/1982 |

*Primary Examiner* — John Kreck

(74) *Attorney, Agent, or Firm* — Robert Becker; Becker & Stachniak, P.C.

(57) ABSTRACT

A method for automatically producing a defined face opening in a longwall mining operation in underground coal mining, using a face conveyor, at least one plow, as an extraction machine, guided on the face conveyor, and respective hydraulic shield support frames having, as main components, a floor skid arrangement, a gob shield, a top canopy and support connection rods. Inclination sensors are disposed on at least three of the floor skid arrangements, the gob shield, the support connection rods and a gob-side region of the top canopy. From the sensors, an inclination relative to a horizontal is ascertained. From the inclination data, by comparison with base data defining a geometrical orientation of the components and movement thereof during a stepping process, a respective shield height of the shield support frames perpendicular to a bed thereof is calculated and is compared with a machine-dependent fixed cutting height of the plow to establish if deviations exist. By means of a boom controller disposed between the shield support frame and the face conveyor, a height control of the plow is initiated to correct established deviations and is maintained, in the sense of a location-synchronized evaluation, until the shield support frame, which trails the plow with a time delay, has reached the position at which the plow was located at the point in time when the height control of the plow was initiated.

16 Claims, 3 Drawing Sheets

U.S. PATENT DOCUMENTS

| | | | | |
|---|---|---|---|---|
| 7,549,709 | B2 * | 6/2009 | Kussel | 299/1.6 |
| 2011/0049964 | A1 * | 3/2011 | Junker et al. | 299/1.7 |
| 2011/0248548 | A1 * | 10/2011 | Junker et al. | 299/1.6 |
| 2012/0161493 | A1 * | 6/2012 | Junker et al. | 299/1.1 |

* cited by examiner

METHOD FOR AUTOMATICALLY PRODUCING A DEFINED FACE OPENING IN PLOW OPERATIONS IN COAL MINING

BACKGROUND OF THE INVENTION

The instant application should be granted the priority date of Feb. 19, 2008, the filing date of the corresponding International patent application PCT/EP2008/001268.

The invention relates to a method for automatically producing a defined face opening in the case of longwall operations, comprising a face conveyor, at least one plow guided on the face conveyor as an extraction machine, and a hydraulic shield support, in underground mining.

A problem in the automatic control of longwall operations both in the mining direction and also in the extraction direction of the extraction machine used is, inter alia, producing a sufficiently large face opening to ensure the passage of the longwall equipment without collisions between extraction machine and shield support frames as the extraction machine travels past, for example, on the one hand, and keeping the rock collapse during the extraction work as limited as possible, and accordingly restricting the extraction work to the coal layer as much as possible, without also cutting excessive country rock, on the other hand. The mineral deposit data which is essentially available before the extraction about seam thickness, level of footwall or overlying stratum, and the presence of saddles and/or troughs both in the mining direction and also in the longitudinal direction of the longwall equipment, i.e. in the extraction direction of the extraction machine, are too imprecise to be able to support automated control of the extraction and support work thereon.

This problem results in particular in the case of so-called plow operations, during which a plow moves back and forth along the longwall front on a fixed guide attached to the face conveyor. The plow, which is equipped with chisels, has a setting-related fixed cutting height and a comparatively low cutting depth in a magnitude of approximately 60 mm, so that in contrast to an extraction with a disc shearer loader, the cutting height is not variable during extraction travel in any case. In plow operations, a height control of the plow is set up as a so-called boom or delivery controller via a control cylinder situated between the face conveyor as a fixed guide to the plow and the shield support frame attached thereon. Via the inclination of the face conveyor, which is changeable using the boom controller, in addition to a level-neutral control, a plunging movement in the mining direction can thus also be given to the face conveyor and thus the plow guided thereon, even during the extraction travel, in which the plow tilts into the footwall by cutting of its floor chisels, or also a climbing movement, in which the plow executes a rising extraction.

In that damage to the footwall by the plow is to be avoided as much as possible during the extraction work, the height control of the plow is essentially performed according to the known method of boundary layer plowing on the footwall. In this method, it is ascertained by a sensor carried at the level of the floor chisel of the plow whether the floor chisel of the plow cuts into the country rock, i.e. into the footwall, or into the coal. This method is primarily fragile on its hardware side, because the relevant sensor and the associated evaluation computer are installed in an extremely rough environment in or on the plow and are thus subject to corresponding stresses and/or occurring defects. Furthermore, the mobility of the plow requires a power supply of the hardware via battery and a data transmission via radio using multiple transponders situated in the longwall, the radio conditions being very difficult to control in particular in low longwalls having higher proportions of ferromagnetic components of the longwall equipment. In addition, this method is also subject to uncertainties in its information and/or also causes a corresponding time delay in the case of possibly required regulation, because a somewhat reliable statement about the material cut by the plow is only to be made after several plow passes, i.e., after it travels past a shield support frame several times, typically approximately 5 times.

The invention is therefore based on the object of disclosing a method of the type cited at the beginning, using which automation of the extraction and support work with respect to the production of a defined face opening is possible even in plowing operation.

SUMMERY OF THE INVENTION

The achievement of this object results, including advantageous embodiments and refinements of the invention, from the content of the patent claims which are appended to this description.

The invention provides a method for this purpose, in which the inclination of the shield components in relation to the horizontal in the stepping direction is ascertained using inclination sensors attached to at least three of the four main components of each shield support frame, such as floor skid, gob shield, supporting connection rods, and gob-side area of the top canopy, and the particular height of the shield support frame perpendicular to the bed at the forward end of the top canopy is calculated from the measured data in a computer unit by comparison with base data, which are stored therein and define the geometric orientation of the components and their movement during the stepping, and in which the ascertained shield height of the shield support frame is compared to the machine-dependent fixed cutting height of the plow, and in which a height control of the plow to be caused via a boom controller existing between shield support frame and face conveyor is initiated to correct established deviations, the initiated height control of the plow being maintained in terms of a location-synchronous analysis, until the shield support frame, which trails the plow with a time delay, has reached the position at which the plow was located at the moment of the initiated height control.

The advantage is connected to the invention that firstly, because of the shield height, which is to be ascertained with comparatively little effort, a parameter is available in adequate precision and reliability for the longwall controller. The other parameter comprises the cutting height of the plow caused by the design of the plow, which is approximately adapted to the thickness of the seam available for the extraction to be expected according to the mineral deposit data. If significant deviations between the cutting height and the shield height are established in the computer unit, a change of the height control of the plow is performed automatically via a corresponding setting of the boom controller. If a significant distance exists between the cutting track of the plow and the tip of the floor skid or the single skids of the shield support frame forming the linkage for the boom controller during plowing operation, a correspondingly long regulation time lag results until the shield height determined on the shield support frame reacts to a height control pulse for the plow, which is initiated on the face conveyor. A complete shield height reaction only occurs 5-7 step actions after initiation of the height control pulse for the plow. Only then can it be checked, by the comparison of cutting height and shield height or by the establishment of the position of the shield support frame in space and thus the face opening, to what extent the initiated change of the height control of the plow results in compensation of the recognized deviation and a change of the face opening. During the passage of the distance from the location of the floor skid of the shield support frame, at which the change of the height position was initiated, to a new location of the floor skid, at which the floor skid reaches the area cut by the plow using the changed height control, no change of the initiated height control is to be performed, although an established deviation remains during this distance. It is thus provided according to the invention that in terms of a location-synchronous analysis, the initiated height control of the plow is maintained until the shield support frame, which trails the plow with a time delay, has reached the position at which the plow was located at the moment of the initiated height control.

Because of the measures according to the invention, a statement is possible about whether the cutting height exposed by the plow also corresponds to the later shield height at this location, or whether possibly occurring collapse or arising convergences result in deviations of the shield height upward or downward from the cutting height, which are to be taken into consideration during the next plow passage by a change of the height control of the plow. This also applies correspondingly for the passage through troughs and/or saddles. The method according to the invention thus essentially uses the ascertained shield height in this regard, in order to set up, with incorporation of the cutting height of the plow, a control loop for controlling the extraction and support work, which results in automatic maintaining of a defined face opening when it is used. The shield height perpendicular to the bed between the upper edge of the top canopy and the lower edge of the floor skid can expediently be used as an indicator for the face height. The shield height in the area of the shield prop is also suitable as a control variable for the height control of the particular shield support frame, because otherwise the relative angle between the top canopy and the floor skid in individual height adaptation phases results in strong height changes with respect to the tip of the top canopy. It can thus be expedient to ascertain-The shield height between top canopy and floor skid at arbitrary points and use the most advisable position for the particular method for the height control.

In the context of the control, the regulation behavior of the system is to be optimized by algorithms which are capable of self-learning and are stored in the computer unit, because a solely geometric incremental procedure cannot simulate all effects occurring in practice, such as floor chisel state, control behavior of the plow in the case of varying footwall composition, upward influence, and mechanical play of the machine equipment. It is thus checked in the context of the computer-supported control whether the face opening intended by the change of the height control of the plow is actually achieved, and the deviations between target data of the initiated height control change and actually occurring face opening are considered in the calculation and specification of later changes of the height control.

According to an exemplary embodiment of the invention, it is provided that shield support frames in a construction having a divided floor skid are also used, in which the stepping mechanism of the shield support frame is situated between the two single skids, so that the two single skids of the shield support frame may be retracted separately from one another, in contrast to skids which are connected to one another, whereby the so-called elephant step is possible as a stepping control. In such shield support frames, which are used in particular in the lesser seam thicknesses, which are typical for plowing operations, one inclination sensor is situated on each of the two single skids.

For this purpose, it can be provided that for each of the two single skids, the particular shield height is calculated from the measured angles of inclination for the top canopy, the gob shield, and for the right and the left single skids of the shield support frame, it being able to be provided that the shield height ascertained for the shield support frame is calculated from the mean value of the shield height values calculated for the two single skids. However, for the recognition of problems caused by prop striking, or for a judgment of whether the upper adjustment limit has been reached in the shield support frame, an individual analysis of the shield height for the right and the left shield halves is required on the basis of the angles of inclination ascertained on the single skids.

In that it is provided according to an exemplary embodiment of the invention that an inclination sensor is situated on the face conveyor and the angle of inclination of the face conveyor is ascertained in the mining direction, the inclination sensor situated on the face conveyor indicates the control direction of the plow and thus provides the foundation for the individual control steps.

In particular, it is provided according to an exemplary embodiment of the invention that on the basis of the angle of inclination of the face conveyor measured in the mining direction, a differential angle is ascertained between the top canopy of the shield support frame and the face conveyor and is incorporated in the calculation of the face opening to be produced by the plow. With the representation of the differential angle, a statement is possible about whether the face opening is made larger or smaller during the next extraction trips or shield steps, and it is thus possible to set up the height control of the plow in such a manner that the predefined target height of the face opening results.

Because of the continuous monitoring of the actual shield height provided according to the invention, it can be checked during the travel of the plow passing the shield support frames whether the face opening produced by the plow is maintained corresponding to the target shield height, or whether deviations upward or downward occur. Corresponding to these deviations, it is possible to perform an automatic height control of the plow, for the execution of the height control of the plow, the initiation of a plunging movement and also the initiation of a climbing movement of the plow in the mining direction by activation of the boom controller being available in a way known per se for the execution of the height control of the plow according to exemplary embodiments of the invention.

The advantage thus results that the height control method for the plow is guided on an intact boundary layer at the overlying stratum, which typically does not impair its course, while in contrast the floor skid frequently does not travel on the natural footwall, but rather along the level which is exposed by the floor chisels of the plow. Upon setting of the shield support frame, in addition, sinking into the artificially produced footwall with a pressure spike occurring close to the skid tip frequently occurs because of the high surface pressure of the floor skid. The sinking of the floor skid does not occur parallel to the layer, but rather is stronger at the skid tip because of the pressure distribution on the floor skid, so that the floor skid executes a type of rotational movement.

It can thus also be provided according to an exemplary embodiment of the invention to ascertain the differential angle between the floor skid of the shield support frame or the corresponding single skids and the face conveyor and to incorporate it in the calculation of the face opening to be produced by the plow, additionally or alternatively to using the angle of inclination of the top canopy sliding on the intact overlying stratum as a guide variable. In the cases in which the floor skid travels on the footwall without significant problems, a control of the shield support frame in consideration of the ascertained skid inclination is sufficient; it is then not necessary to ascertain a skid angle.

A control requirement for the plow regularly and necessarily occurs during the passage of pronounced troughs and/or saddles in the mining direction. Thus, for example, the approach of a saddle is recognized by the established inclination change of the top canopy of the shield support frame pressing against the overlying stratum. The height change can be calculated from the amount of the inclination change between two advance steps of the shield support in terms of a reduction of the height for each further step action of the relevant shield support frame. In order to keep the face opening at the predefined target level and counteract the reduction of the face opening, a height control movement in terms of a plunging movement is to be initiated on the plow, for example. Subsequently, before a saddle high point is passed over, an inclination change of the top canopy to the horizontal is recognizable. This is to be used to control the plowing work with an adaptation of the height control of the plow in a timely manner, so that the target height of the face opening is thus maintained even when passing the saddle. Corresponding control actions, but with reversed signs, are to be set when passing a trough, in which the same directional sequences fundamentally prevail. It is thus provided according to an exemplary embodiment of the invention that, via the ascertainment of the inclination of the top canopy of the shield support frame in the mining direction, the course of troughs and/or saddles in the mining direction is established, and via the established changes of the inclination of the top canopy over a predefined period of time, the change of the face opening is predicted and the height control of the plow is set accordingly.

The inclination sensors situated on the shield support frames also give an amount for the inclination of the shield support frames transversely to the mining direction, because saddles and troughs may also be pronounced in the travel direction of the plow in the longwall course. Because the course of the overlying stratum and footwall in the longitudinal direction of the longwall equipment may be derived from the transverse inclination of the shield support frames, it is provided according to an exemplary embodiment of the invention that the course of troughs and/or saddles in the extraction direction of the plow is established via the ascertainment of the inclination of the individual shield support frames transversely to the mining direction and the height control of the plow is set such that a sufficient passage height of the plow is ensured at the shield support frames.

The comparison of the target shield height to the actual shield height can be superimposed with the occurrence of convergence, which reduces the exposed face opening against the support action of the shield support used. It is thus provided according to an exemplary embodiment of the invention, that if the value for the shield height falls below the value for the cutting height, the occurring convergence is ascertained and the convergence is compensated for, for example by a corresponding plunging movement of the plow with footwall cutting. In a special embodiment of the invention, it is provided that in case of planned operating shutdowns, the face opening is enlarged by the amount of a convergence to be expected over the duration of the operating shutdowns.

According to an exemplary embodiment of the invention, it can be provided that the power consumption of the plow drive for the plow during the travel of the plow passing the individual shield support frames is detected and recorded and an analysis is performed in the computer unit, as to what extent the plow runs in individual longwall sections because of normal power consumption on the boundary layer from the seam to the footwall or whether a high power consumption identifies a footwall cut of the plow. If the shield height corresponds to the seam thickness available from the mineral deposit data, additional information, according to which the plow runs at the boundary layer to the footwall, can be very helpful. If, for example, in spite of correspondence of the shield height with the seam thickness, it is recognizable in phases via the high plow power demand that apparently the footwall is also being cut, the cutting guide of the plow is to be adapted in the direction of a lower face opening, in order to further avoid also cutting the footwall. Vice versa, a face height which is too low can be recognized if the lower boundary layer to the footwall is not reached and the danger thus exists of losing coal on the footwall, i.e., not extracting all of the coal down to the footwall layer. Not only does a delivery loss of valuable coal result therefrom, but rather possibly also a fire hazard in the coal layer which is left standing.

According to an exemplary embodiment of the invention, it is provided that acceleration sensors are used as the inclination sensors, which detect the angle of the acceleration sensor in space via the deviation from the Earth's gravity. The angle in relation to the vertical is thus determined physically, which is to be converted into the angle of inclination for the inclination of the shield components to the horizontal. It can be provided, to eliminate errors caused by the vibrations of the components used, that the measured values ascertained by the acceleration sensors are checked and corrected using a suitable damping method.

BRIEF DESCRIPTION OF THE DRAWINGS

Exemplary embodiments of the invention, which are described hereafter, are shown in the drawing. In the figures.

DESCRIPTION OF THE SPECIFIC EMBODIMENTS

Figure 1:
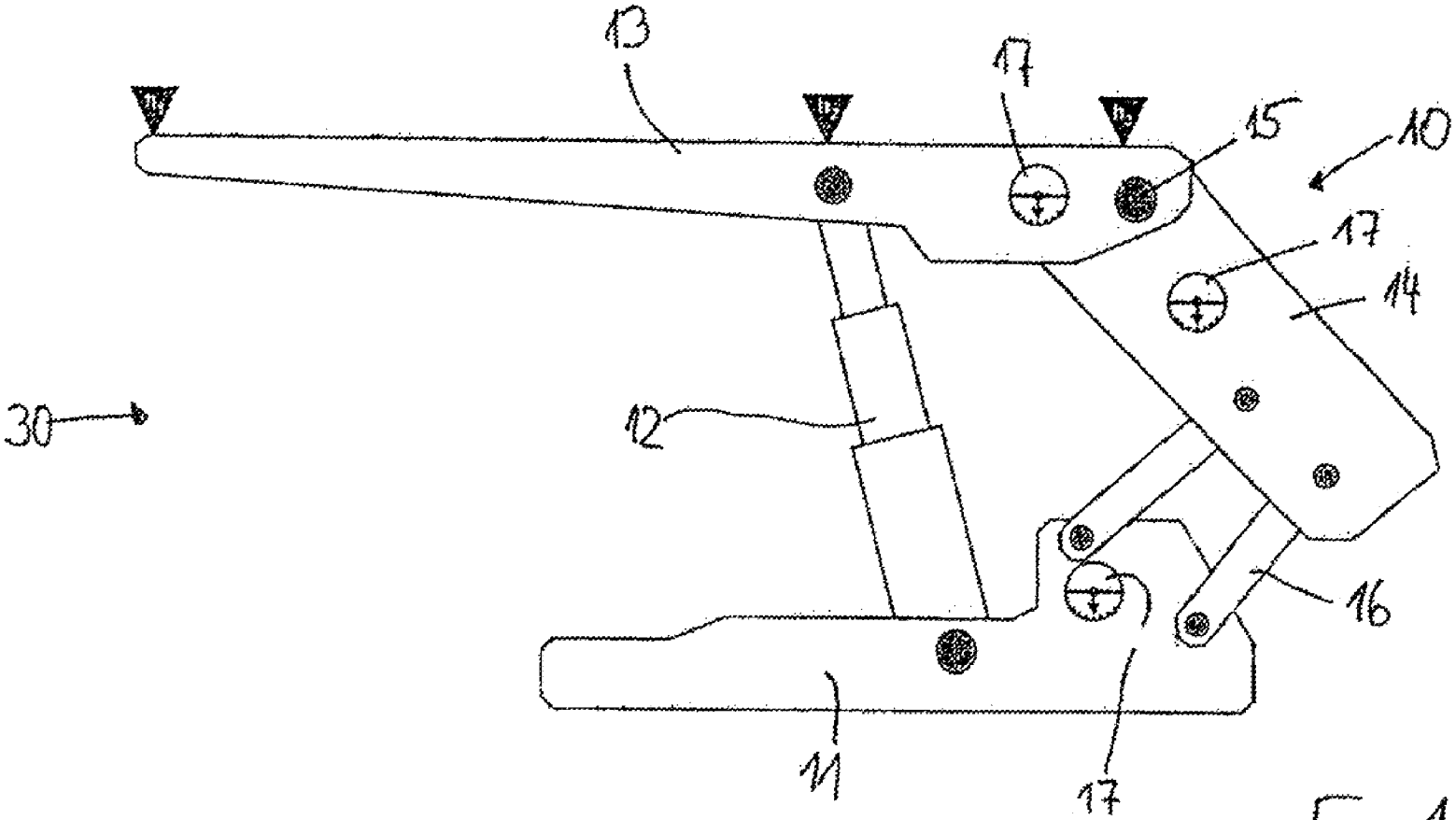
FIG. 1 shows a shield support frame in a schematic side view.

The shield support frame 10 shown in FIG. 1 comprises a floor skid 11, on which two props 12 are placed in parallel configuration, of which only one prop is recognizable in FIG. 1, which carries a top canopy 13 on its upper end. While the top canopy 13 protrudes at its front (left) end in the direction of the extraction machine (to be described hereafter), a gob shield 14 is linked using a joint 15 on the rear (right) end of the top canopy 13, the gob shield being supported by two supporting connection rods 16, which rest on the floor skid 11 in the side view. In the exemplary embodiment shown, three inclination sensors 17 are attached to the shield support frame 10, one inclination sensor 17 on the floor skid 11, one inclination sensor 17 in the rear end of the top canopy 13 in proximity to the joint 15, and one inclination sensor 17 on the gob shield 14. As is not shown in greater detail, an inclination sensor can also be provided on the fourth movable component of the shield support frame 10, the connection rods 16, three inclination sensors having to be installed of the four possible inclination sensors 17 in each case, in order to determine the position of the shield support frame in a working area using the inclination values ascertained therefrom. The invention is thus not restricted to the concrete configuration of the inclination sensors shown in FIG. 1, but rather comprises all possible combinations of three inclination sensors on the four movable components of the shield support frame.

In a computer unit, on the basis of the known kinematics data stored therein, which define the geometric orientation of the components and their movement during stepping, the heights $h_1$, $h_2$, and $h_3$ can be ascertained depending on the position of floor skid 11, gob shield 14, and top canopy 13 to one another, the height $h_1$ applying for ascertaining the height perpendicular to the bed of the face opening 30, while the height $h_2$ forms a measure of a possible excess height when the shield support frame is completely extended or for a striking danger, while the height $h_3$ can be used to observe the convergence. The heights $h_1$, $h_2$, and $h_3$ can be ascertained on the basis of the measured values of the inclination sensors 17, the values measured by the sensors 17 being compared in the described computer unit to the base data stored therein for the geometrical orientation of the components and their movement behavior to one another. For this purpose, it is provided that the individual shield support frames 10 are calibrated after their installation in the longwall equipment, in that the top canopy 13, the gob shield 14, and the floor skid 11 are calibrated using manual inclinometers in the installed state and the measured values are input into the corresponding controller of the shield support frame 10. If the height values $h_1$, $h_2$, and $h_3$ are displayed in the shield controller, these height values can be re-measured using measuring tapes and the inclination sensors can subsequently be calibrated accordingly.

Figure 3:
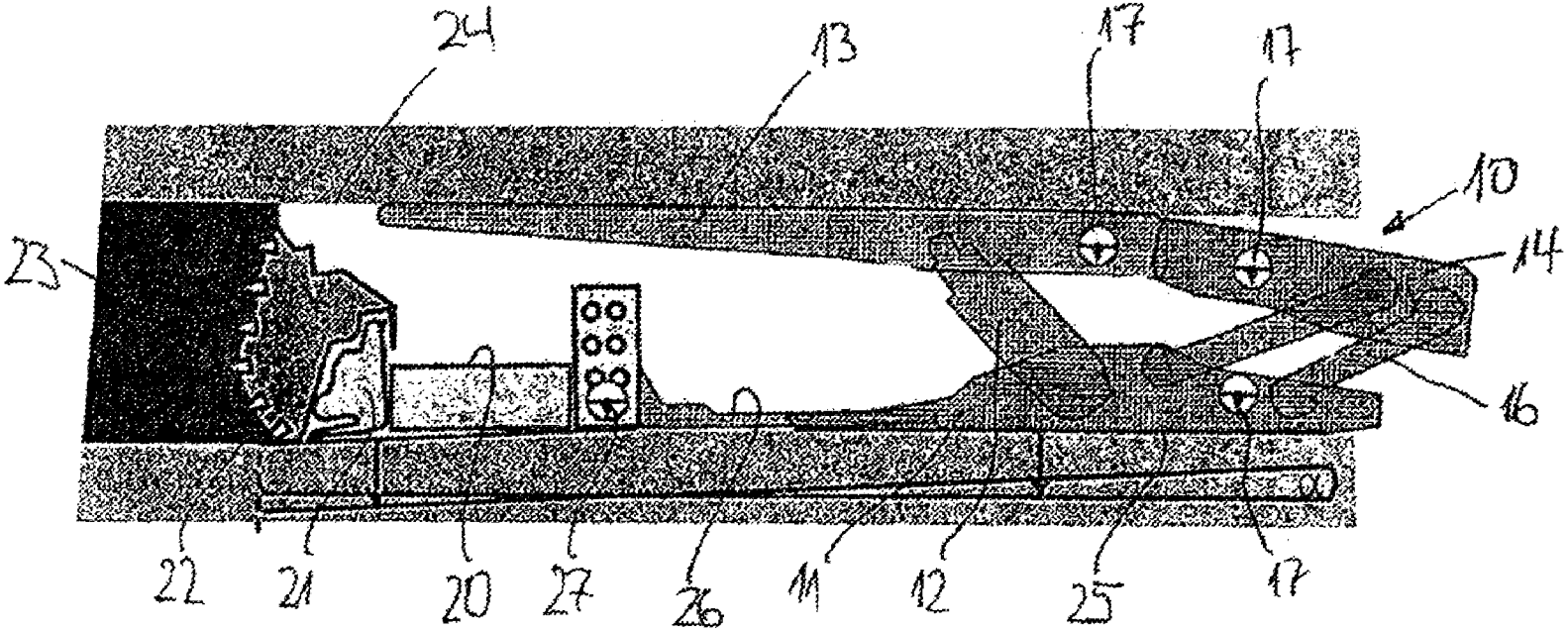
FIG. 3 shows longwall equipment having plow, face conveyor, and a shield support frame according to FIG. 1 or FIG. 2 in a schematic view.

As shown in FIG. 3, the illustrated shield support frame 10 is attached to a face conveyor 20, which has a plow guide 21 for a plow 22 movable along the face conveyor 20. The canopy overlying stratum is identified by the reference numeral 24 and the footwall of the seam 23 is identified by the reference numeral 25 in FIG. 3.

The face conveyor 20 is connected using a boom controller 26 to the assigned shield support frame 10, the face conveyor 20 being adjustable in its position in relation to the horizontal in the mining direction via the boom controller 26, so that by raising or lowering the stops for the boom controller 26 on the face conveyor 20 on the side of the shield support, a plunging movement or a climbing movement is to be transmitted to the plow. An inclination sensor 27 is situated on the face conveyor 20 to establish the location of the face conveyor 20 or to monitor the geris or adjusted height control.

The shield support frame 10 which is shown in a side view in FIG. 1 can fundamentally have three constructions with respect to its floor skid. As firstly shown in FIG. 2*a*, the floor skid 11 comprises two partial skids, which are fixedly connected to one another via a fixed steel construction 28, however, so that a so-called "tunnel skid" results. This tunnel skid does have better vertical mobility, but higher surface pressures occur and thus a higher tendency toward sinking of the two partial skids into the footwall.

Figures 2A, 2B, 2C:
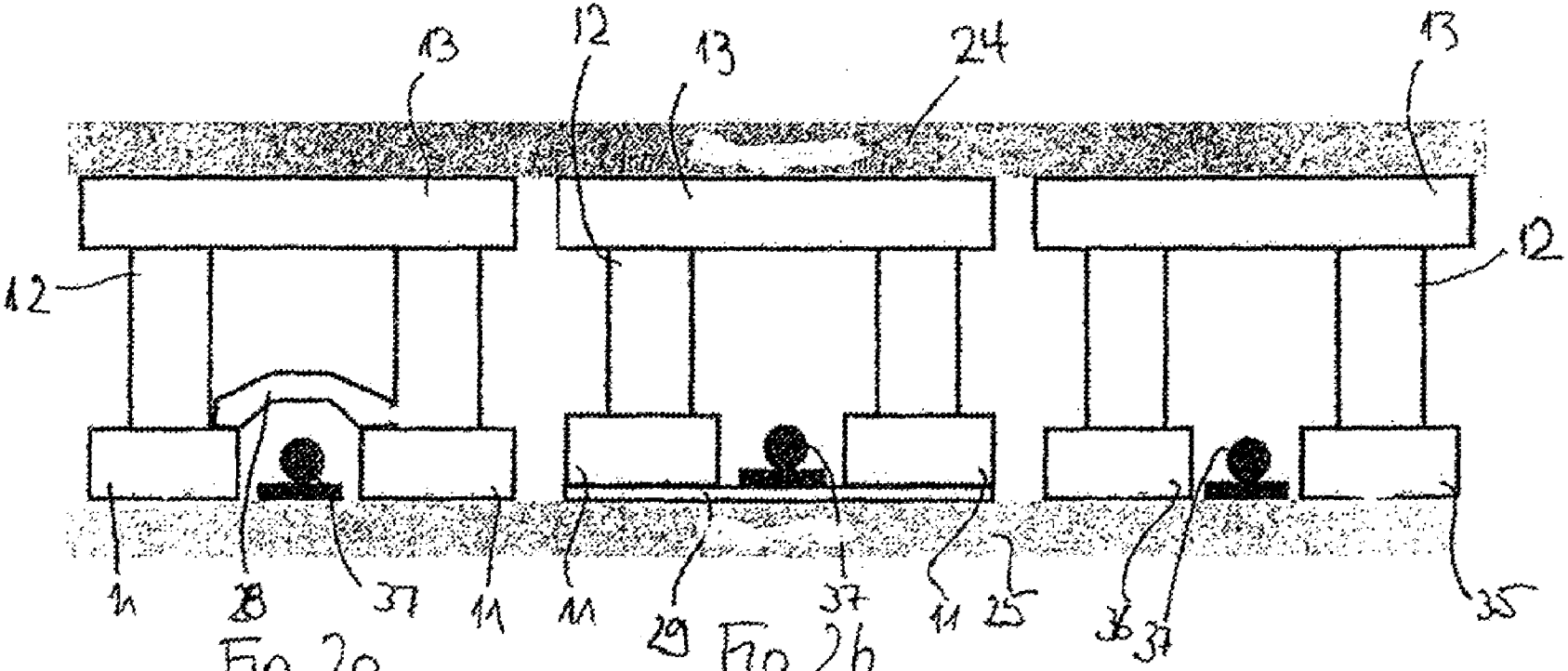
FIGS. 2*a-c* each show a shield support frame having different embodiments of its floor skid in a front view.

Alternatively thereto, according to FIG. 2*b*, the floor skid can be implemented having two partial skids, which are connected to one another via a floor plate 29, so that a larger bearing surface for the floor skid results. The surface pressure is thus reduced and thus the tendency that the shield support frame presses into the footwall in particular in the area of the skid tips. However, this construction restricts the mobility for rapid changes of the shield height, because in particular in the event of a rapid increase of the shield height, the stepping mechanism 37 cannot follow a rapidly descending face conveyor, because the stepping mechanism presses against the closed floor plate 29, which limits the possibility of the height adaptation.

Finally, an embodiment is shown in FIG. 2*c*, which is preferably used in plowing operations in the event of a small seam thickness, for example less than 1.5 m. In this embodiment, separate single skids 35 and 36 are provided, between which the stepping mechanism 37 is situated so that the right single skid 35 in the stepping direction can be raised independently of the left single skid 36 in the stepping direction. This separation of the single skids 35 and 36 allows the stepping of the shield support frame 10 in the so-called elephant step, using which sinking of the two single skids 35 and 36 into the footwall 23 and collection and pushing of debris in front of the single skids 35, 36 can be counteracted. Debris of this type would not flow away rapidly enough in the direction of the gob field under specific operating conditions without appropriate countermeasures and would increasingly obstruct or, in an advanced stage, even prevent the stepping action. During the stepping action, the shield support frame 10 is initially relieved by small retracting of its two props 12. However, the prop connected to a single skid is subsequently retracted, so that the relevant single skid can be raised again and can slide on the debris lying on the footwall as the shield support frame advances. When the shield is placed, the relevant single skid stands on the elevated level. During the next stepping action, the same cycle is performed with the sides reversed using the other single skid, so that the individual stepping actions complete a type of "trampling step". Using the same technique, it is also possible to raise a single skid sunken into the footwall back to the footwall level.

FIG. 3 schematically shows that the top canopy 13 presses against the undisturbed overlying stratum 24 of the seam 23. It is only shown as an example to illustrate the height control in FIG. 3 that in the position recognizable from FIG. 3, a plunging movement has been transmitted to the plow 22, in that the face conveyor 20 was slightly raised using the boom controller 26. The plow 22 cuts slightly into the footwall 25, so that at the floor skid 11 of the shield support frame 10, which is still standing on the original level of the footwall 25, a differential angle a to the footwall level cut by the plow 22 results. The change of the face opening during the further extraction trips of the plow 22 may be calculated via this differential angle a and the position of the shield components ascertained by the inclination sensors 17 on the shield support frame 10.

On the basis of the progressing observation of the current shield height or its development over the time axis, it can be ascertained in each case whether the shield height corresponds to the thickness of the seam 23, which is to be inferred from the available mineral deposit data, in the area under extraction, with incorporation of the information from a boundary layer detector set up on the plow 22, as to whether or not the plow 22 is cutting into the country rock, preferably into the footwall 25. The control of the extraction and the support work can thus be placed on a secure basis in consideration of all three data sets.

In that the height control of the plow 22 is to be performed so that, on the one hand, cutting into the overlying stratum 24 and, on the other hand, a contact with the top canopy 13 of the individual shield support frames 10 of longwall equipment is to be prevented, a sensor system can be set up in order to recognize undesired contacts of the plow 22 of this type, because the establishment of contacts of this type can also be included for supplementary purposes as control data in the method control. Thus, as the plow 22 travels along a shield support frame 10, a top canopy or shield top contact can be recognized, in that firstly a power spike of the plow drive power indicates the (braking) contact of the plow 22, the pressure of the boom cylinder between face conveyor 20 and shield support frame 10 rises rapidly as a result of an elevated occurring restoring torque, the travel of the relevant boom cylinder as a result of the elevated restoring torque indicates rapid elastic yielding by more than the typical travel and/or the inclination sensor 27 on the face conveyor 20 experiences a strongly accelerated rapid angle change.

A top canopy or shield top contact of the top chisel of the plow 22 can thus be recognized, which is reasonably usable in particular at low seam thicknesses for controlling the extraction and support work, because upon the occurrence of such contacts, the height control of the plow can be set to automatically initiate a plunging movement, so that undesired contacts in the top canopy or in the shield top area of this type can be avoided, possibly by accepting a footwall cut.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of international application PCT/EP2008/001268, filed Feb. 19, 2008.

The present invention is, of course, in no way restricted to the specific disclosure of the specification and drawings, but also encompasses any modifications within the scope of the appended claims.

The invention claimed is:

1. A method for automatically producing a defined face opening in a longwall mining operation in underground coal mining, including the steps of:

providing a face conveyor;

providing at least one plow, as an extraction machine, wherein said plow is guided on said face conveyor;

providing respective hydraulic shield support frames that include, as main components, a floor skid arrangement, a gob shield, a top canopy, and support connection rods;

disposing inclination sensors on at least three of the group consisting of said floor skid arrangement, said gob shield, said support connection rods and a gob-side region of said top canopy;

ascertaining from said inclination sensors an inclination of those components of said shield support frames that are provided with said inclination sensors relative to a horizontal;

in a computer, calculating from the ascertained inclination data, by a comparison with base data stored in the computer and which base data defines a geometrical orientation of the shield support frame components as well as a movement thereof during a stepping process, a respective shield height of said shield support frames perpendicular to a bed of said shield support frames;

comparing the calculated shield height of a respective shield support frame with a machine-dependent fixed cutting height of said plow to establish if deviations exist;

disposing a boom controller between said shield support frame and said face conveyor;

initiating a height control of said plow, via said boom controller, to correct established deviations; and maintaining the initiated height control of said plow, in the sense of a location-synchronized evaluation, until said shield support frame, which trails said plow with a time delay, has reached the position at which said plow was located at the point in time when said height control of said plow was initiated.

2. A method according to claim 1, wherein said floor skid arrangement is a divided floor skid that includes two individual skids, further wherein a step mechanism is disposed between said two individual skids, and wherein a respective one of said inclination sensors is disposed on each of said individual skids.

3. A method according to claim 2, wherein for each of said two individual skids a respective shield height is calculated from measured angles of inclination for said top canopy, said gob shield, and for each of said individual skids.

4. A method according to claim 3, wherein the shield height ascertained for said shield support frame is calculated from the mean value of the shield height values calculated for said two single skids.

5. A method according to claim 1, wherein a further inclination sensors disposed on said face conveyor, and wherein an angle of inclination of said face conveyor in a direction of mining is ascertained with said further inclination sensor.

6. A method according to claim 5, which includes the further steps of ascertaining a differential angle between said top canopy and said face conveyor on the basis of said angle of inclination of said face conveyor measured in the direction of mining, and incorporating said differential angle in a calculation of the face opening that is to be produced by said plow.

7. A method according to claim 5, which includes the further steps of ascertaining a differential angle between said face conveyor and said floor skid arrangement, or individual skids thereof, on the basis of said angle of inclination of said face conveyor measured in the direction of mining, and incorporating said differential angle in a calculation of the face opening that is to be produced by said plow.

8. A method according to one of claim 1, wherein said step of initiating a height control of said plow via said boom controller is effected by initiating a plunging movement of said plow in a direction of mining using a footwall cutting.

9. A method according to claim 1, wherein said step of initiating a height control of said plow via said boom controller is effected by initiating a climbing movement of said plow in a direction of mining.

10. A method according to claim 1, which includes the further steps of establishing a course of troughs and/or saddles in a direction of mining via ascertainment of the inclination of said top canopy in the direction of mining; predicting a change of the face opening via established changes of the inclination of said top canopy over a predetermined period of time; and in conformity therewith setting the height control of said plow.

11. A method according to one of claim 1, which includes the further steps of establishing a course of troughs and/or saddles in a direction of extraction of said plow via ascertainment of the inclination of individual ones of said shield support frames transverse to a direction of mining, and setting a height control of said plow such that a sufficient passage height of said plow is ensured at said shield support frames.

12. A method according to claim 1, which includes the further steps of ascertaining the convergence that occurs when the value of the shield height of said shield support frames falls below the value for a cutting height of said plow, and compensating for said convergence by an appropriate plunging movement of said plow accompanied by footwall cutting.

13. A method according to claim 12, which, in the event of a planned operating shutdown, includes the further step of enlarging the face opening by the amount of a convergence that is to be expected over the duration of the operating shutdown.

14. A method according to claim 13, which includes the further steps of detecting and recording the power consumption of a plow drive for said plow as said plow travels past relative to individual ones of said shield support frames; and carrying out in the computer an analysis as to what extent, in individual longwall sections, either said plow runs at a boundary layer from a seam to a footwall on the basis of a normal power consumption, or whether a high power consumption indicates a footwall cut of said plow.

15. A method according to claim 1, wherein acceleration sensors are used as inclination sensors, and wherein said acceleration sensors detect an angle of said acceleration sensor in space via a deviation from acceleration due to gravity.

16. A method according to claim 15, which includes the further step of checking and correcting measured values ascertained by said acceleration sensors using a suitable damping method to eliminate errors caused by vibrations of the components that are utilized.

* * * * *